United States Patent [19]

Tsujimoto et al.

[11] Patent Number: 4,827,306

[45] Date of Patent: May 2, 1989

[54] DISCHARGING APPARATUS AND METHOD FOR USE IN A COPYING MACHINE

[75] Inventors: Yoshiharu Tsujimoto, Suita; Hiroshi Kinashi, Uji; Yuhi Yui, Nara; Teruhiko Noguchi, Sakai; Itaru Kawabata, Kashiwara, all of Japan

[73] Assignee: Sharp Kabushiki Kaisha, Osaka, Japan

[21] Appl. No.: 788,738

[22] Filed: Oct. 17, 1985

[30] Foreign Application Priority Data

| | | | |
|---|---|---|---|
| Oct. 17, 1984 | [JP] | Japan | 59-219220 |
| Oct. 17, 1984 | [JP] | Japan | 59-219221 |
| Oct. 17, 1984 | [JP] | Japan | 59-219222 |
| Oct. 17, 1984 | [JP] | Japan | 59-219223 |
| Nov. 13, 1984 | [JP] | Japan | 59-240254 |

[51] Int. Cl.[4] ..... G03G 15/00

[52] U.S. Cl. ..... 355/3 CH; 355/210; 355/206; 430/54

[58] Field of Search ..... 355/3 R, 3 CH, 14 E, 355/14 R, 14 CH, 15, 67, 69–70; 361/212; 430/31, 54

[56] References Cited

U.S. PATENT DOCUMENTS

| | | | |
|---|---|---|---|
| 801,115 | 0/0000 | Herman et al. . | |
| 3,511,649 | 0/0000 | Felty et al. | 96/1 |
| 3,826,569 | 7/1974 | Sakamaki et al. | 355/14 E |
| 4,084,538 | 0/0000 | Tanaka | 355/3 DD X |
| 4,119,373 | 10/1978 | Frishman et al. | 355/3 R |
| 4,170,413 | 10/1979 | Bayer | 355/67 X |
| 4,248,524 | 2/1981 | Takahashi | 430/31 X |
| 4,260,238 | 4/1981 | Kozuka et al. | 355/3 R X |
| 4,380,386 | 4/1983 | Yasuda et al. | 355/3 R |
| 4,443,093 | 4/1984 | Yoshino et al. | 430/31 X |
| 4,508,446 | 4/1985 | Imai | 355/14 E X |
| 4,522,904 | 6/1985 | Kina et al. | 355/14 E X |
| 4,529,292 | 7/1985 | Ohseto | 355/3 CH |
| 4,538,900 | 9/1985 | Lutus et al. | 355/15 X |
| 4,621,920 | 11/1986 | Takahashi | 355/3 CH X |

FOREIGN PATENT DOCUMENTS

| | | | |
|---|---|---|---|
| 0154042 | 9/1985 | European Pat. Off. | 355/14 C |
| 3248363A1 | of 0000 | Fed. Rep. of Germany . | |
| 53-148444 | of 1978 | Japan . | |

*Primary Examiner*—A. C. Prescott
*Assistant Examiner*—Jane Lau
*Attorney, Agent, or Firm*—Birch, Stewart, Kolasch & Birch

[57] ABSTRACT

A discharging apparatus for use in a copying machine for discharging the photoreceptor layer laminated on a drum includes a short wavelength light source for producing a light having a wavelength shorter than 6000 angstrom, and a long wavelength light source for producing a light having a wavelength longer than 6200 angstrom. A control circuit is provided for controlling both light sources such that both light sources are turned on during at least one complete rotation of the drum before an exposure of a light image on the photoreceptor layer.

16 Claims, 7 Drawing Sheets

DISCHARGING APPARATUS AND METHOD FOR USE IN A COPYING MACHINE

BACKGROUND OF THE INVENTION

1. Field of the Invention

The present invention relates to a photoelectric copying machine and, more particularly, to an apparatus and method for discharging the photoconductive layer made of a selenium alloy, or the like, to provide a constant and stable initial condition of the photoconductive layer at the beginning of each copying operation, thereby providing a uniform copied paper at any time during the series of operations.

2. Description of the Prior Art

When a photoconductive plate or layer made of a selenium alloy, or the like, is subjected to repeated cycles of charging, exposure and discharging, an effect known as fatigue is encountered. This effect is manifested as an increase in the dark decay rate of the plate potential, i.e., decrease charge retention. Fatigue in amorphous selenium is caused by the build-up, within the photoconductive film, of trapped charges which produce a high field condition at the interface between the film and the conductive substrate. These internally trapped charges also produce an increased residual potential.

If a fatigued photoconductive layer is allowed to rest in the dark it will gradually return to its original normal condition. Fatigue is not an important factor when the period between use cycles is long, or in cases where several plates can be used in rotation. However, in rapid cycling, the effect of fatigue may become troublesome, producing poor copies, such as copies with insufficient darkness of the dark lines, copies with a blur on the white areas, or copies with a ghost image, which is an image remaining from the previous copying operation. This problem becomes more and more serious when the photoconductive layer is made of $As_2Se_3$ having a high sensitivity to light. Also, since the fatigue progresses logarithmically during the series of copying operations, the condition of the imaged copy paper is different from those obtained at the beginning and those obtained at the end. Thus, it has been difficult to obtain a uniform condition for all of the copy papers obtained during a series of copying operations. The above is discussed in detail in a book "ELECTROPHOTOGRAPHY" written by R. M Schaffert.

Various methods and devices have been proposed to overcome the problems described above, one of which is disclosed in U.S. Pat. No. 3,511,649 issued to E. J. Felty et al in which a light source producing lights having a waveform shorter than 5400 angstrom is employed to prevent th effect of fatigue. However, in the case where the high sensitive plate $As_2Se_3$ is operated at rapid cycling, this arrangement results in insufficient discharge of the plate, regardless of an increase of the light amount, thereby resulting in the increase of the residual voltage which provides blur on the white areas.

Another prior art device is disclosed in Japanese Patent Publication (unexamined) No. 53-148444 of Xerox Corp. published Dec. 25, 1978. This patent publication is based on U.S. patent application Ser. No. 801,115 filed May 27, 1977. According to this reference, a pre-fatigue system is employed such that the photoconductive plate is exposed, before a series of copying operations, so as to receive light having a peak at 6200 angstrom. Thus, the fatigue in the plate is progressed intentionally to a certain degree before the first copying operation. Although this arrangement may give a stable initial corona charge during the first number of cycles of the copying operation, the residual voltage may increase after the number of cycles of the copying operation are carried out serially. Thus, the problem of obtaining a uniform condition for all the copy papers during a series of copying operations still exists.

Yet, another prior art device is disclosed in Japanese Patent Publication (unexamined) No. 58-114082 published July 7, 1983. According to this reference the discharging step and the corona charging step are carried out with a time interval of more than 0.2 second, which is sufficiently long to neutralize the trapped charges within the photoconductive layer. When this arrangement is employed, the photoconductive layer will not be fatigued, thereby providing a uniform condition for all the copy papers. However, with this arrangement, it is not possible to realize the rapid cycling of the copying operation.

In addition to the above, the photoconductive layer is susceptible to temperature such that the dark decay rate changes with respect to the temperature change. This change is caused by the change of the number of charges trapped within the photoconductive layer with respect to temperature. Thus, when temperature changes, there arises the same problems as discussed above, such as the insufficient darkness of the dark liens, blur in the white areas, or production of a ghost image.

To overcome the above problem caused by the temperature change, various methods and devices are proposed. One such solution is disclosed in Japanese Patent Publication (examined) No. 55-40971 in which a temperature detector is provided for detecting the temperature of the photoconductive layer. The bias voltage for developing the latent image is changed with respect to the temperature. However, this method has the problem such that the center portion of the dark areas will not be as dark as the peripheral portion.

SUMMARY OF THE INVENTION

The present invention has been developed with a view to substantially solving the above described problems and has for its essential object to provide an improved apparatus and method for discharging a photoconductive layer made of a selenium alloy, or the like, and to provide a constant and stable initial condition of the photoconductive layer at the beginning of each copying operation, thereby providing a uniform image on the copy paper at any time during the series of operations.

It is also an essential object of the present invention to provide a discharging apparatus of the above described type which is simple in construction and can be manufactured at a low cost.

In accomplishing these and other objects, a discharging apparatus for use in a copying machine according to the present invention comprises a short wavelength light source for producing a light having a wavelength shorter than 6000 angstrom, and a long wavelength light source for producing a light having a wavelength longer than 6200 angstrom. The present invention further comprises a control circuit for controlling both light sources such that both light sources are turned on during at least one complete rotation of the drum before an exposure of a light image on the photoconductive layer.

BRIEF DESCRIPTION OF THE DRAWINGS

These and other objects and features of the present invention will become apparent from the following description taken in conjunction with preferred embodiments thereof with reference to the accompanying drawings, throughout which like parts are designated by like reference numerals, and in which.

DESCRIPTION OF THE PREFERRED EMBODIMENTS

Figure 1:
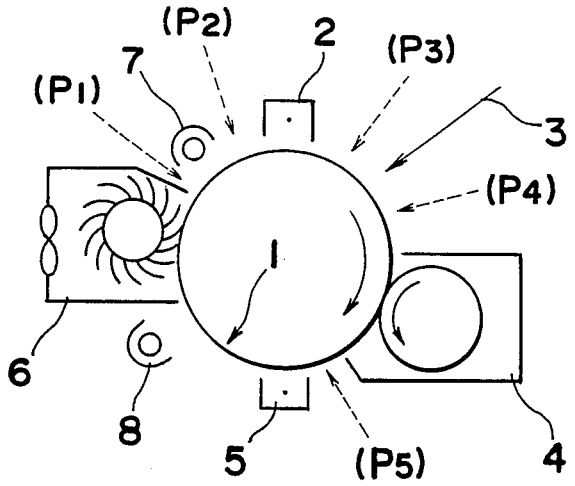
FIG. 1 is a mechanical schematic of a copying machine showing an arrangement of a photoconductive drum with various apparatuses provided therearound including the discharging apparatus of the present invention.

Referring to FIG. 1, a copying machine according to the present invention is shown. A corona charging device 2 is provided to deposit a uniform electrostatic charge of about 700 volts to 1000 volts on the surface of a photoconductive drum 1. Photoconductive drum 1 is arranged to rotate in the direction indicated by an arrow and has a diameter of about 60 millimeters to 140 millimeters, with a photoreceptor layer of $As_2Se_3$ laminated therearound. The thickness of the photoreceptor layer is about 60 micrometers. As illustrated by an arrow 3, a light image of a document to be reproduced is projected onto the drum surface to form an electrostatic latent image thereon. Thereafter, the latent image is developed by a developing device 4 to form a toner powder image in the configuration of the latent image on the drum surface. The powder image may then be transferred to a copy paper by a transfer device 5, and it is permanently affixed to the copy paper in a known manner. Thereafter, the drum surface is cleaned by a cleaning device 6 to remove the toner powder remaining on the drum surface.

A discharging device defined by a pair of light sources 7 and 8 are provided adjacent cleaning device 6 such that light source 7 for emitting a short wavelength light (peak point is less than 6000 angstrom) is positioned between cleaning device 6 and corona charger 2, and light source 8 for emitting a long wavelength light (peak point is greater than 6200 angstrom) is positioned between cleaning device 6 and transfer device 5. For the short wavelength light source 7, any one of a fluorescent lamp, EL or LED may be employed. For the long wavelength light source 8, a EL or LED may be employed. Also, the two light sources 7 and 8 may be so actuated as to emit light simultaneously or sequentially one after another in any order.

Figure 2:
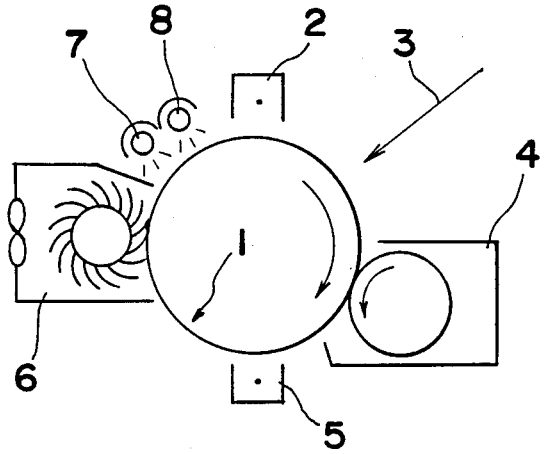
FIG. 2 is further schematic similar to FIG. 1, but particularly showing a modification thereof.

It is to be noted that the long wavelength light source 8 may be positioned any place around drum 1, such as at a position P1, P2, P3, P4 or P5 shown in FIG. 1. FIG. 2 shows a case in which the long wavelength light source 8 is located at position P2.

Figure 4:
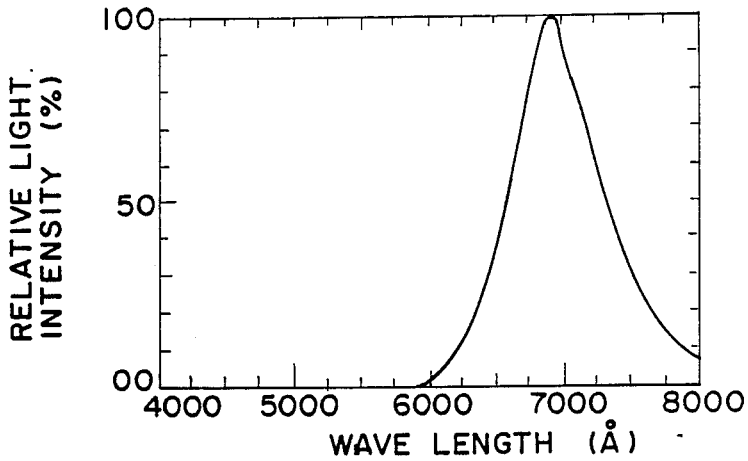
FIGS. 4, 5 and 6 are graphs showing relative light intensity of the light sources employed in the present invention.
Figure 5:
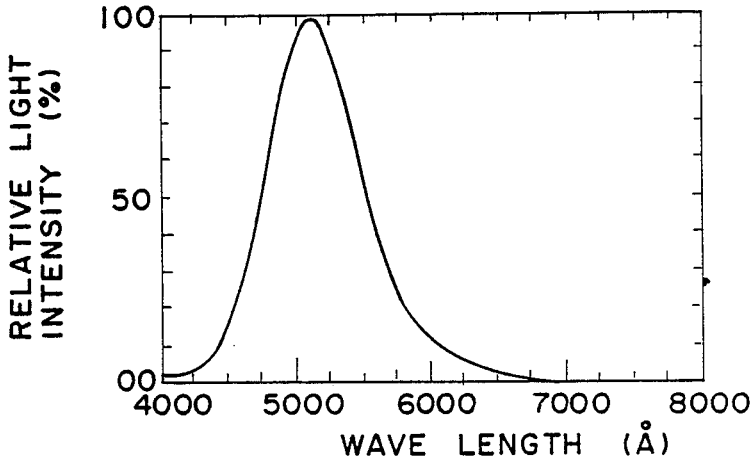
Figure 6:
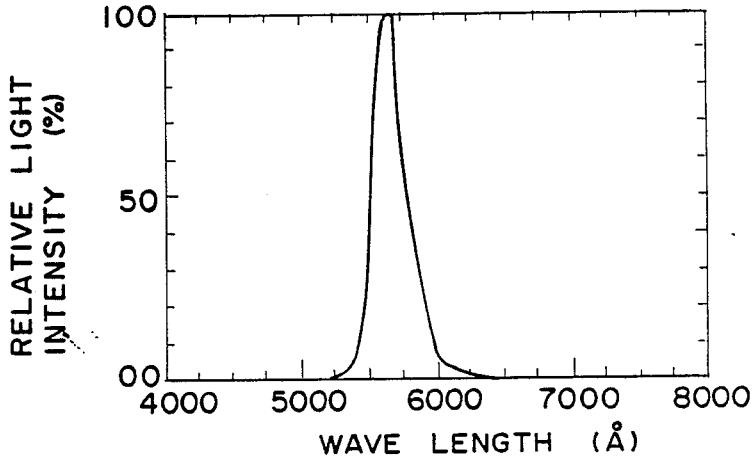

According to a preferred embodiment, the long wavelength light source 8 has a peak point at 7000 angstrom, as shown in FIG. 4 and, as shown in FIG. 5, the short wavelength light source 7 has a peak point at 5030 angstrom. FIG. 6 shows a relative intensity of a light source which may be used for the short wavelength light source 7.

Figure 3:
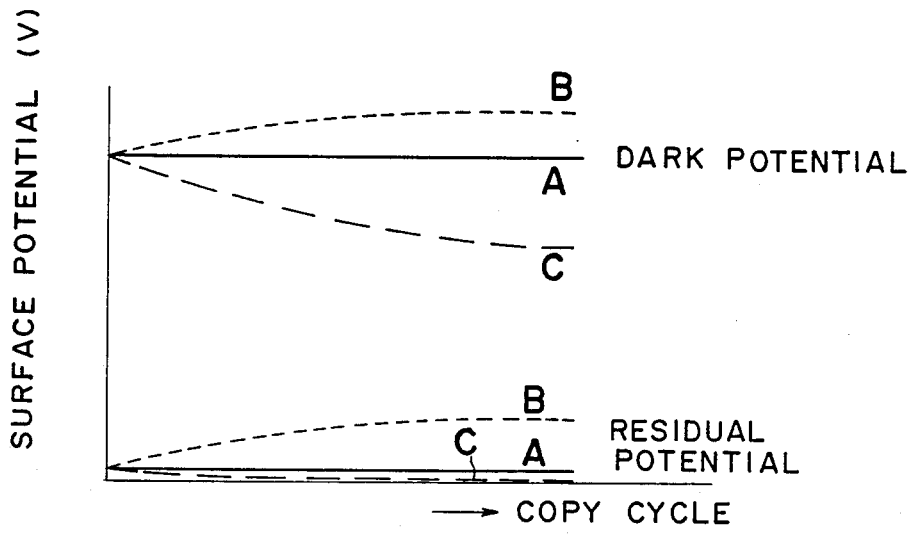
FIG. 3 is a graph showing the change of the dark potential and residual potential during the series of copying cycles.

Referring to FIG. 3, a graph shows the change in the surface potential during the repetition of copy cycles. In the graph, the dark potential is measured at developing device 4 provided that a completely dark image is exposed at the exposure station where the arrow 3 is pointing. The residual potential is measured at position P2 (FIG. 1), i.e., immediately before the corona charger 2.

When only one discharge light having a short wavelength (6000 angstrom or shorter) is used in the low speed copying cycle, the dark potential, as well as the residual potential, is maintained constant, as depicted by a solid line A. This can be understood from the following explanation. When the drum is rotated at a slow speed, the time interval between the discharging device and the charging device is relatively long, for example, more than 0.2 second. Thus, the carriers in the photoconductive layer can be coupled and neutralized completely, resulting in the constant dark potential. Although this arrangement provides a uniform copy through out the series of copying cycles, the speed is very slow.

When the drum is rotated at a high speed, the time interval between the discharging device and the charging device becomes very short, such as less than 0.2 second or shorter. Under this condition when the drum surface is exposed with only one discharging light having a short wavelength (6000 angstrom or shorter), the residual potential gradually increases as the number of copying cycles increase, as shown by a curve B in FIG. 3. Under this arrangement, copies become poor, as mentioned above, as the number of copying cycles increase.

When the drum is rotated at a high speed with only one discharging light having a long wavelength (6200 angstrom or longer) or a white light, some light rays intrude into the photoconductive layer, thereby enhancing the discharging effect. In this case, since the long wavelength light rays intrude into the photoconductive layer, trapped electrons are produced internally in the photoconductive layer. Thus, in this case, the residual potential is maintained approximately constant, but the dark potential gradually decreases as the number of copying cycles increase, as shown by a curve C in FIG. 3.

In light of the above, the present invention uses, in the high speed copying machine, a short wavelength light and a bit of long wavelength light for discharging the drum. These two lights are used at the controlled amount as described below.

The amount of light to be emitted from the short wavelength light source 7 and applied on the drum surface, as measured on the drum surface, is about 5 to 50 times, preferably 10 to 20 times, the half-decay exposure amount, wherein the half-decay exposure amount is an amount of light energy necessary to reduce the electric charge deposited on the drum surface to half. Also, the amount of light to be emitted from the long wavelength light source 8, as measured on the drum surface, is about 0.1 to 10 times, preferably 0.5 to 5 times, the half-decay exposure amount. To determine the specific light amount, factors such as the diameter of the drum, and the speed of the drum, the emission spectrum of light sources 7 and 8 are taken into consideration.

Before each copying operation, drum 1 makes at least one complete rotation, during which light sources 7 and 8 turn on to effect the discharge completely around drum 1. When the discharge of the drum is effected in the above described manner, the dark potential and residual potential can be maintained to a constant level, such that the photoconductive layer is forcibly fatigued to a certain level and this level is maintained during the copying operation, thereby producing copy papers of constant condition.

Figure 7:
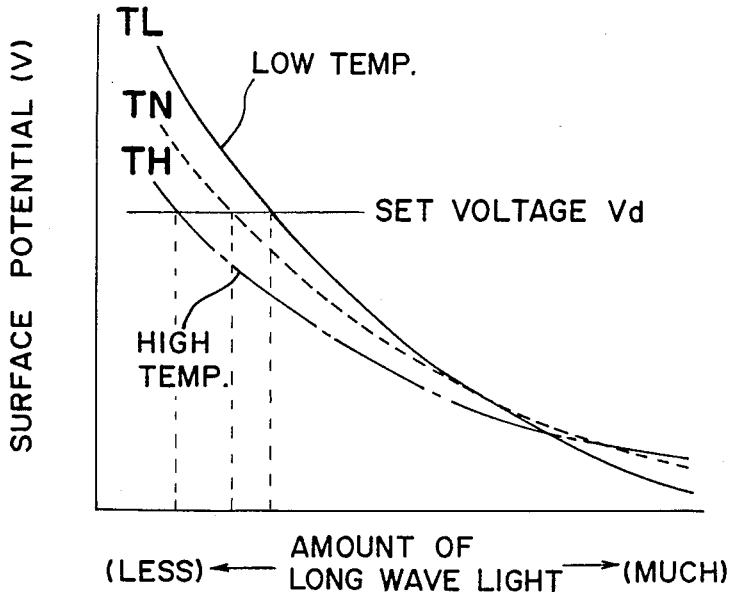
FIG. 7 is a graph showing a change in the surface potential with respect to the change in the amount of long wavelength light contained in the light source.

Referring to FIG. 7, the change of the surface potential with respect to the change of amount of the long wavelength light under three different temperatures is shown. A curve TL shows the change of dark potential measured under a low temperature, a curve TN under a normal temperature and a curve TH under a high temperature. To obtain a constant set voltage Vd, the amount of long wavelength light should be changed such that the amount of long wavelength light is made less as the temperature increases. The same can be said of the residual potential.

Figure 8:
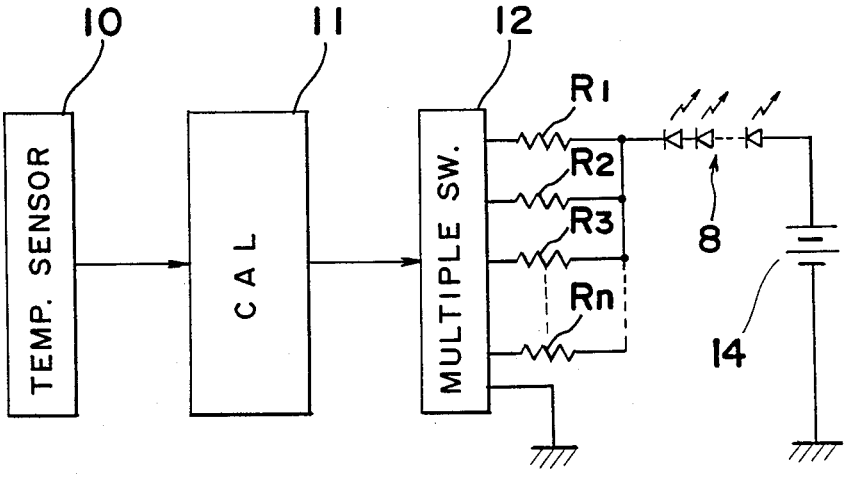
FIG. 8 is a circuit diagram for controlling the light source of the long wavelength light based on the detected temperature.

Referring to FIG. 8, a circuit diagram for controlling light source 8 is shown. Temperature sensor 10 is provided so as to detect the temperature of the photoconductive layer. The detected temperature is supplied to a calculator 11 in which a memory (not shown) is provided for storing a relationship between the temperature and the amount of long wavelength light. The output signal from the calculator 11 is applied to a multiple switching circuit 12 which has n outputs connected to resistors R1, R2, ... and Rn, respectively, and further to a series connection of LEDs defining a long wavelength light source 8. Light source 8 is further connected to a power source 14. Based on the signal provided from calculator 11, multiple switch 12 connects one or more resistors to ground thereby defining a current path from light source 8 to ground through one or more resistors. By the number of resistors used for the current path, the amount of current permitted to flow through light source 8 is determined, thereby controlling the amount of light to be emitted from light source 8. A detail of the circuit of FIG. 8 is disclosed, for example, in Japanese Patent Publication (unexamined) No. 55-53376.

Figure 9:
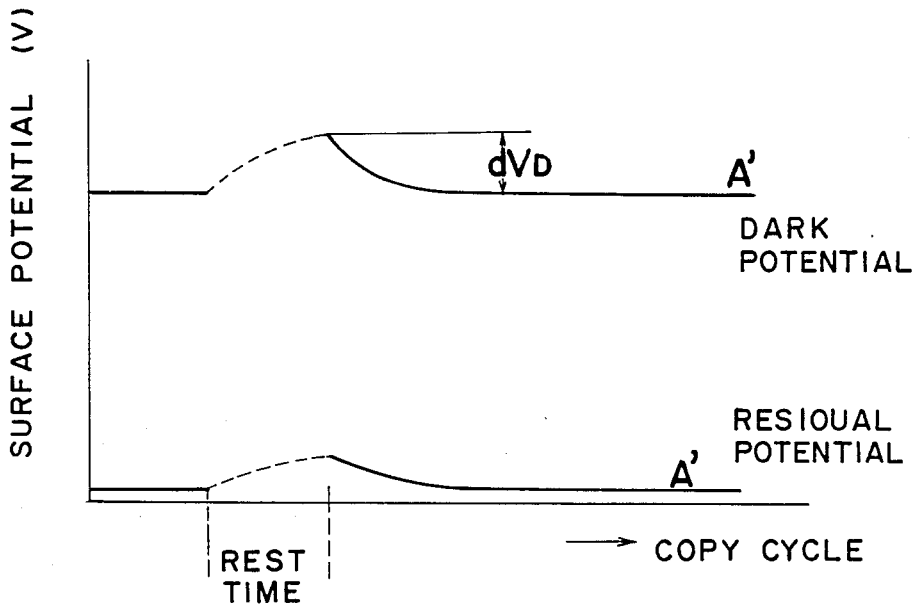
FIG. 9 is a graph showing a change in the surface potential during and after the rest time.
Figure 10:
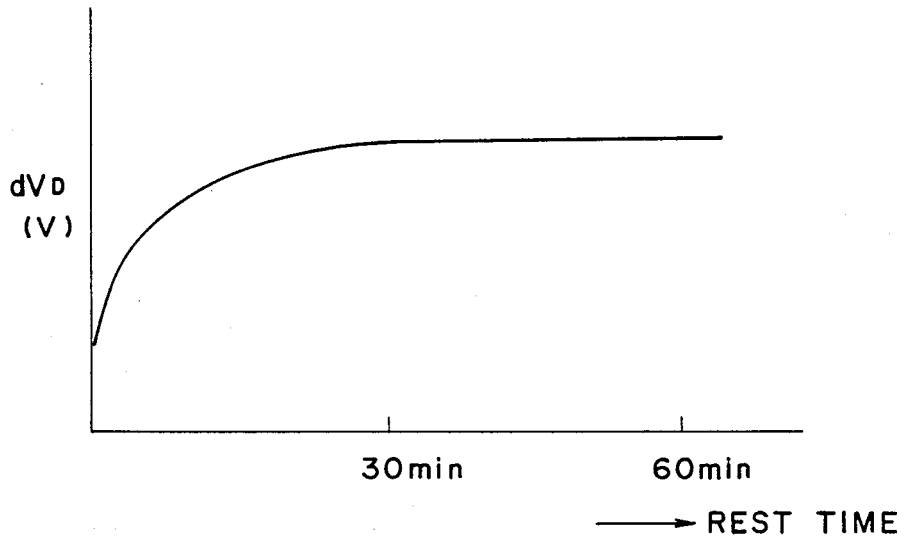
FIG. 10 is graph showing a change in the surface potential after the rest time.

Referring to FIG. 9, the change of the surface potential, particularly the dark potential and residual potential, during and after the rest time is shown. Before the rest time, i.e., during the working time in which the copying cycles are repeated continuously, the dark potential and the residual potential is stable such that the photoconductive layer is maintained in a certain degree of fatigued condition. When the copying operation ends and enters into the rest time, the photoconductive layer rests in the dark. Thus, it is allowed to gradually recover from the fatigued condition thereby gradually increasing the the surface potential by an amount $dV_D$. The manner in which the surface potential increases by an amount $dV_D$ during the rest time is shown in FIG. 10. Then, when the copying cycle starts again, the dark potential, as well as the residual potential, decreases gradually due to the gradual set up of the fatigue in the photoconductive layer. Thus, the dark potential gradually decreases. During the gradual decrease of the dark potential, the condition of the copy paper changes.

Figure 12:
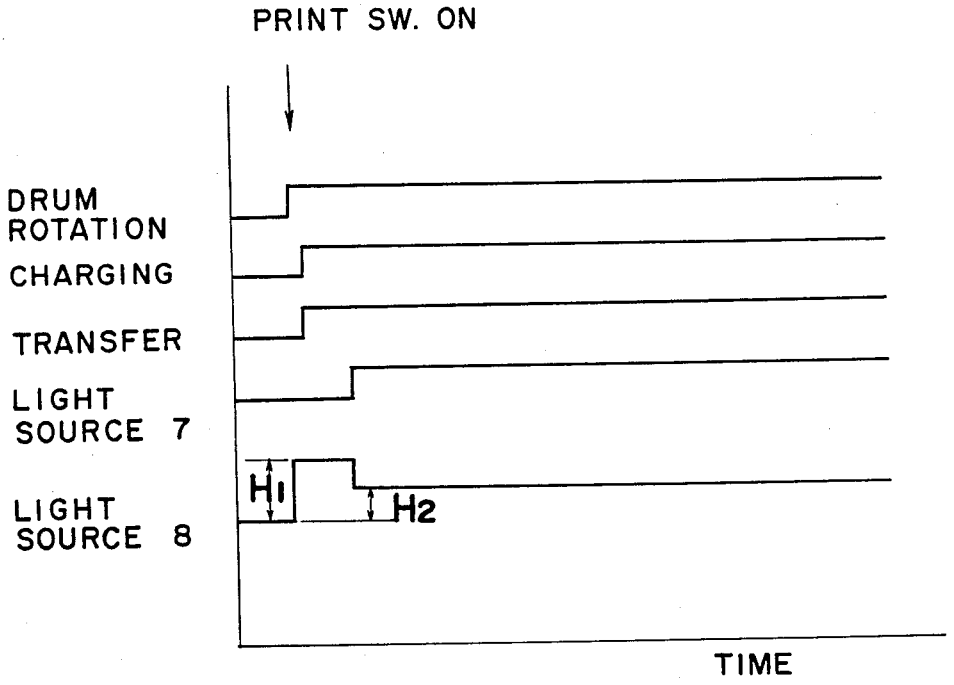
FIG. 12 is a chart showing the sequential operation of the various stations provided around the photoconductive drum.

To avoid the change in the condition of the copy paper during the restart of the copying machine, the fatigue is forcibly built-up in the photoconductive layer before the start of the first copying operation after the rest time. To this end, the long wavelength light from light source 8 is intensified, such as shown by a high H1 in FIG. 12, immediately after the turn on of the print switch (not shown). As the height H1 becomes taller, the effect for setting up the fatigue becomes stronger. The degree of the fatigue to be built-up after the turn on of the print switch is dependent on the degree of recovery of the photoconductive layer acquired during the rest time.

Figure 11:
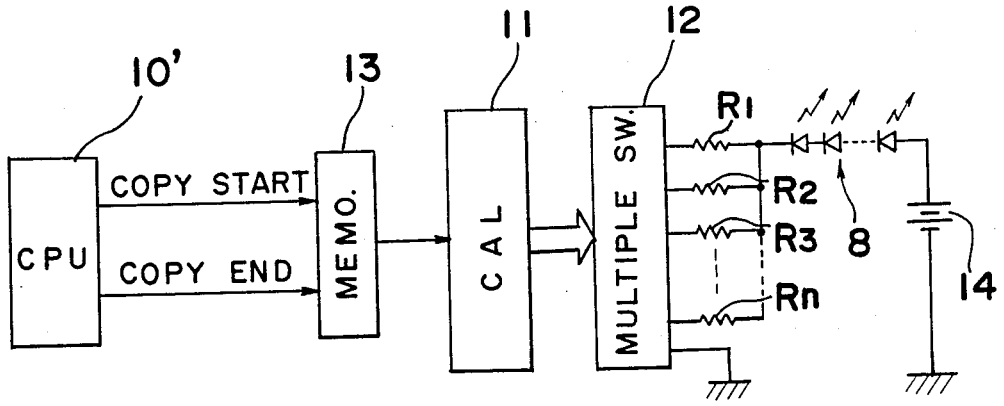
FIG. 11 is a circuit diagram for controlling the light source of the long wavelength light based on the rest time.

Referring to FIG. 11, a circuit for controlling the light source 8, according to the present invention, is shown. A memory 13 is stored with data indicating the degree of the fatigue to be built-up after the turn on of the print switch and the length of the rest time. By the use of copy start signal and copy end signal obtained from CPU 10', memory 13 counts the length of the rest time and produces a signal indicating the degree of fatigue to be built-up after the turn on of the print switch. Then, calculator 11 calculates a necessary current for producing the light H1 having a high intensity. Based on the calculated result, multiple switch 12 is so actuated as to allow current flow through a number of resistors. The light with the high intensity H1 is maintained on at least during the first complete rotation of the drum. Thereafter, calculator 11 produces a signal for emitting a light H2 with a normal intensity sufficient to maintain the photoconductive layer in a predetermined fatigued condition.

Figure 13:
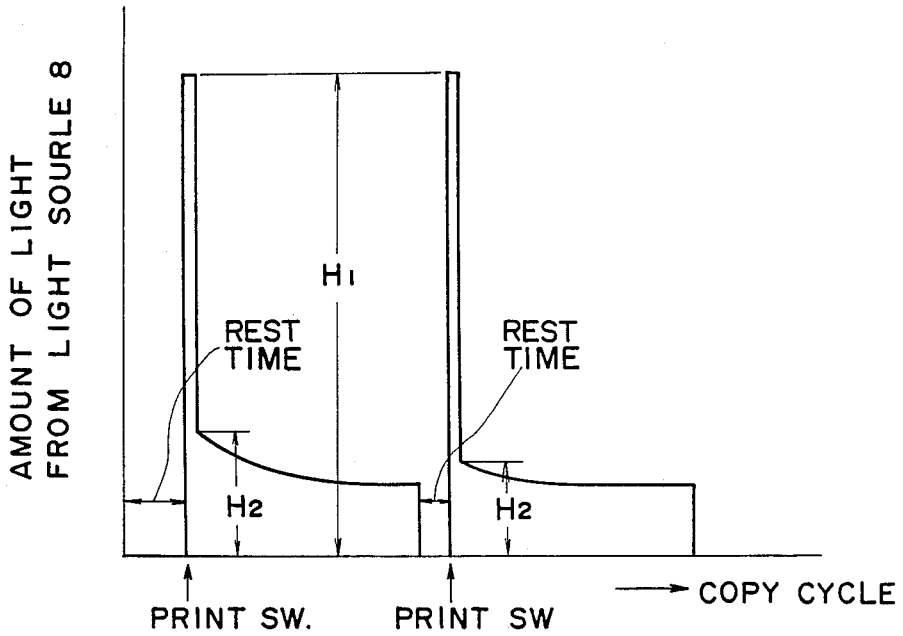
FIG. 13 is a graph showing the amount of light produced from the long wavelength light source in two subsequent copying procedures.

In the case where the fatigue in the photoconductive layer can not be acquired to the predetermined degree by the exposure of a single intensive light H1 emitted rom light source 8 immediately after the rest time, the light H2 emitted from light source 8 for the second cycle of copying operation after the rest time is made a little stronger than the normal intensity, as indicated in the graph of FIG. 13. Then, in the third cycle of copying operation, the light H2 is weakened a little, but still stronger than the normal intensity. In this manner, the light H2 is gradually weakened until it settles to the normal intensity. By that time, the fatigue in the photoconductive layer is set up to the predetermined level which is maintained through out the rest of the copying cycles, thereby providing a uniform copying condition.

As illustrated in FIG. 13, the intensity of the light H2 is dependent on the length of the rest time. As the rest time becomes longer, the intensity of the light H2 is made greater. To this end, memory 13 (FIG. 11) is stored with data representing the relationship between the length of the rest time and the strength of the light H2 to be emitted in the second cycle of operation. Also, memory 13 is stored with a data which gives the gradual decrease of the light H2 during the copying operation after the second cycle.

Figure 14:
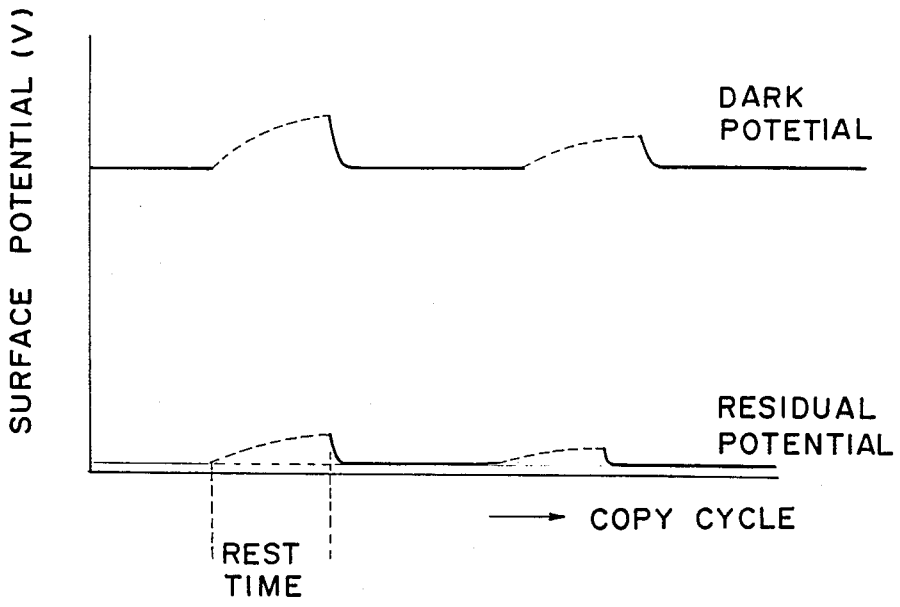
FIG. 14 is graph showing a change in the surface potential during and after the rest time occurring serially.

According to the present invention, the discharging device is defined by short wavelength light 7 and long wavelength light 8. By the control of the amount of light emitted from long wavelength light 8 in a manner described above, it is possible to maintain the photoconductive layer in a constant fatigued condition not only during the series of copying operations, but also immediately after the rest time which may be either long or short. Thus, according to the present invention, the dark potential, as well as the residual potential, is maintained constant when ever the copying operation is required, as indicated in the graph of FIG. 14. Also, even when the temperature of the photoconductive layer changes, the photoconductive layer is controlled to have the same degree of fatigue, thereby providing a uniform condition of the copying operation.

Figure 15:
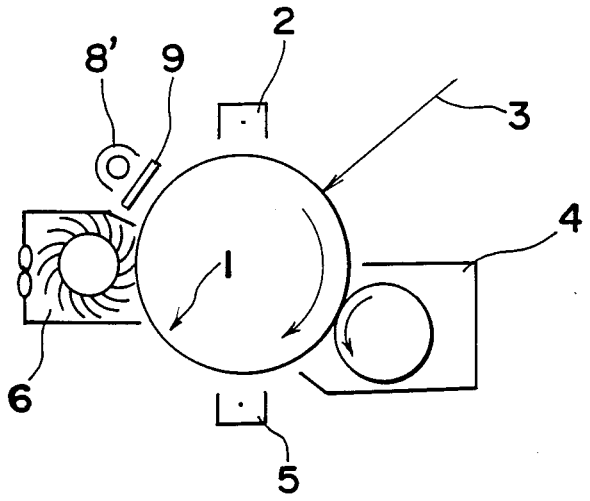
FIG. 15 is a diagrammatic view similar to FIG. 1, but particularly showing a modification employing a filter.
Figure 16:
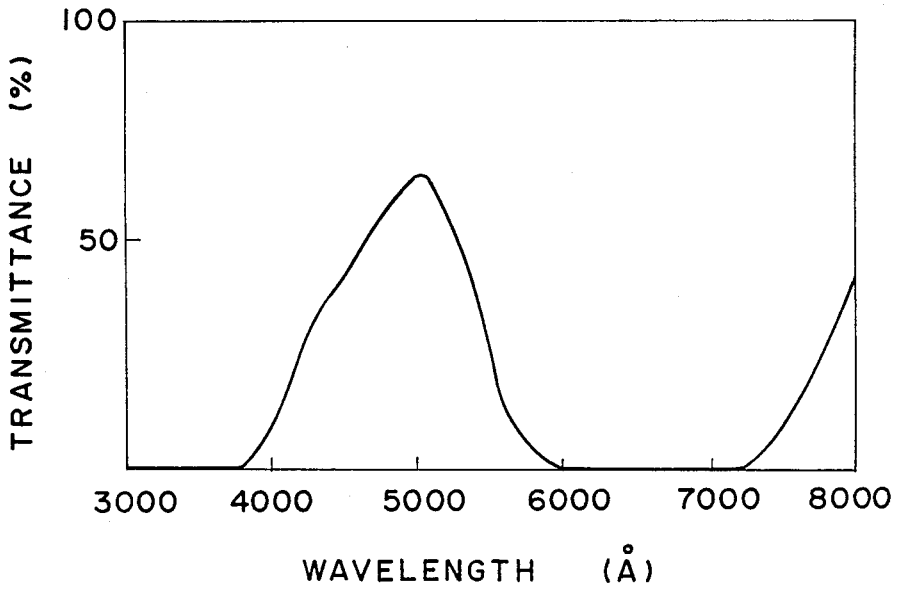
FIG. 16 is a graph showing transmittance characteristics of the filter shown in FIG. 15.

According to the present invention, instead of using two lights 7 and 8 for the discharging device, it is possible to use one light 8' and an optical filter 9 placed in front of light 8', as shown in FIG. 15. Light 8' emits light rays having wavelength of 4000–8000 angstroms and optical filter 9 has a transmittance characteristics as shown in FIG. 16 such that light rays having wavelength of 6000–7000 angstroms are cut off.

Although the present invention has been fully described with reference to several preferred embodiments, many modifications and variations thereof will now be apparent to those skilled in the art, and the scope of the present invention is therefore to be limited not by the details of the preferred embodiments described above, but only by the terms of the appended claims.

What is claimed is:

1. A copying machine inclusive of a discharge means for discharging a photoreceptor layer comprising:

a photoconductive drum having a photoreceptor layer comprising $As_2Se_3$ thereon;

a charging device;

a separate first discharging light source for producing a light having a wavelength shorter than 6000 angstrom on the surface of said photoreceptor surface positioned about the periphery of said photoconductive drum;

a separate second discharging light source for producing a light having a wavelength longer than 6200 angstrom on the surface of said photoreceptor surface positioned about the periphery of said photoconductive drum; and control means for controlling said first and second light sources such that said first and second light sources are turned on during at least one complete rotation of said photoconductive drum before exposure of a light image on the surface of said photoreceptor layer wherein said first light source emits light such that the amount of light, as measured on the surface of said photoreceptor layer, is about 5 to 50 times the half-decay exposure amount, wherein the half-decay exposure amount is an amount of light energy necessary to reduce the electric charge deposited on the photoreceptor layer in half, and wherein said second light source emits light such that the amount of light, as measured on the surface of said photoreceptor layer, is about 0.1 to 10 times the half-decay exposure amount, said control means including a count means for counting the length of a rest time of said copying machine, and wherein said control means controls said second light source such that the amount of light to be emitted therefrom increases as the length of a rest time increases, with a time interval between said last positioned discharge light source and said charging device being less than 0.2 second.

2. A copying machine as in claim 1, wherein said first light source emits light such that the amount of light, as measured on the photoreceptor layer surface, is about 10 to 20 times the half-decay exposure amount, wherein the half-decay exposure amount is an amount of light energy necessary to reduce the electric charge deposited on the photoconductive layer in half, and wherein said second light source emits light such that the amount of light, as measured on the photoreceptor layer surface, is about 0.5 to 5 times the half-decay exposure amount.

3. A copying machine as in claim 1, wherein said control means has a count means for counting the length of a rest time of said copying machine, and wherein said control means controls said second light source such that the light to be emitted therefrom before the first cycle of copying operation and after the rest of the copying operation is set to a first level, and the light to be emitted therefrom after the first cycle of copying operation is set to a second level which is lower than said first level.

4. A copying machine as in claim 3, wherein said first level increases as the rest time increases.

5. A copying machine as in claim 3, wherein said second level gradually decreases to a predetermined level relative to the increase of the number of the copying cycles.

6. A copying machine as in claim 5, wherein said second level is dependent on the length of the rest time such that the second level increases as the rest time increases.

7. A method for use in a copying machine for discharging the surface of a photoreceptor layer of a photoconductive drum, said method comprising:

applying a first light to a photoreceptor layer of a photoconductive drum having a wavelength shorter than 6000 angstrom during at least one complete rotation of said photoconductive drum before exposure of a light image on said photoreceptor layer;

applying a second light having a wavelength longer than 6200 angstrom during at least one complete rotation of said photoconductive drum before an exposure of a light image on said photoreceptor layer;

measuring the temperature of said photoreceptor layer; and controlling the application of said second light such that the amount of the second light increases as the detected temperature decreases.

8. A method as in claim 7 further comprising the steps of:

counting the length of a rest time of the copying machine; and controlling the application of said second light such that said second light to be emitted before the first cycle of a copying operation and after the rest of the copying operation is set to a first level, and said second light to be emitted after the first cycle of a copying operation is set to a second level which is lower than said first level.

9. A method as in claim 8, wherein said first level increases as said rest time increases.

10. A method as in claim 8, wherein said second level gradually decreases to a predetermined level relative to the increase of the number of the copying cycles.

11. A method as in claim 10, wherein said second level is dependent on the length of the rest time such that the second level increases as the rest time increases.

12. A method as in claim 7, wherein said photoconductive layer is formed of a compound of selenium and arsenic.

13. A method for use in a copying machine for discharging a photoreceptor layer of a photoconductive drum, said method comprising:

applying a first light to a photoreceptor layer of a photoconductive drum having a wavelength shorter than 6000 angstrom during at least one complete rotation of said photoconductive drum before exposure of a light image on said photoreceptor layer;

applying a second light having a wavelength longer than 6200 angstrom during at least one complete rotation of said photoconductive drum before an exposure of a light image on said photoreceptor layer;

measuring the temperature of said photoreceptor layer;

controlling the application of said second light such that the amount of the second light increases as the detected temperature decreases;

counting the length of a rest time of the copying machine; and controlling the application of said second light such that the amount of said second light increases as the length of rest time increases.

14. A copying machine inclusive of a photoconductive layer, a charging device and a discharging means comprising a first light source for producing light having a first wavelength shorter than 600 nm and a second light source for producing light having a second wavelength longer than 620 nm, both light sources being directed at said photoconductive layer for discharging it, characterized in that said photoconductive layer comprises $Ae_2Se_3$, a time interval between said discharging means and said charging device is less than 0.2 second, the exposure of the surface of said photoconductive layer effected by said first light source is about 5 to 50 times the half-decay exposure, and that at least the exposure of the surface of said photoconductive layer effected by said second light source is adapted to be set to a value in the range of about 0.1 to 10 times the half-decay exposure and is controllable in dependence on copying parameters, the half-decay exposure being the exposure necessary to reduce by half the electrical charge applied to said photoconductive layer.

15. A copying machine inclusive of a discharge means for discharging a photoreceptor layer comprising:

a photoconductive drum having a photoreceptor layer comprising $As_2Se_3$ thereon;

a charging device;

a separate first discharging light source for producing a light having a wavelength shorter than 6000 angstrom on the surface of said photoreceptor surface positioned about the periphery of said photoconductive drum;

a separate second discharging light source for producing a light having a wavelength longer than 6200 angstrom on the surface of said photoreceptor surface positioned about the periphery of said photoconductive drum;

control means for controlling said first and second light sources such that said first and second light sources are turned on during at least one complete rotation of said photoconductive drum before exposure of a light image on the surface of said photoreceptor layer wherein said first light source emits light such that the amount of light, as measured on the surface of said photoreceptor layer, is about 5 to 50 times the half-decay exposure amount, wherein the half-decay exposure amount is an amount of light energy necessary to reduce the electric charge deposited on the photoreceptor layer in half, and wherein said second light source emits light such that the amount of light, as measured on the surface of said photoreceptor layer, is about 0.1 to 10 times the half-decay exposure amount, said control means including a count means for counting the length of a rest time of said copying machine, and wherein said control means controls said second light source such that the amount of light to be emitted therefrom increases as the length of a rest time increases the time interval between said last positioned discharge light source and said charging device being less than 0.2 second; and a temperature sensor for detecting the temperature of said photoconductive layer, wherein said control means controls said second light source such that the amount of light to be emitted therefrom increases as the detected temperature decreases.

16. A copying machine as in claim 15, wherein said first light source emits light such that the amount of light, as measured on the photoreceptor layer surface, is about 10 to 20 times the half-decay exposure amount, wherein the half-decay exposure amount is an amount of light energy necessary to reduce the electric charge deposited on the photoconductive layer in half, and wherein said second light source emits light such that the amount of light, as measured on the photoreceptor layer surface, is about 0.5 to 5 times the half-decay exposure amount.

* * * * *